US010753590B1

(12) United States Patent
Deng

(10) Patent No.: US 10,753,590 B1
(45) Date of Patent: Aug. 25, 2020

(54) EXPLOSION PROOF LAMP

(71) Applicant: EVERY INDUSTRY LLC, Rancho Dominguez, CA (US)

(72) Inventor: Jinsheng Deng, Rancho Dominguez, CA (US)

(73) Assignee: EVERY INDUSTRY LLC, Rancho Dominguez, CA (US)

( * ) Notice: Subject to any disclaimer, the term of this patent is extended or adjusted under 35 U.S.C. 154(b) by 0 days.

(21) Appl. No.: 16/362,726

(22) Filed: Mar. 25, 2019

(51) Int. Cl.

| | |
|---|---|
| ***F21V 25/12*** | (2006.01) |
| ***F21S 8/00*** | (2006.01) |
| ***F21V 15/02*** | (2006.01) |
| ***F21V 17/12*** | (2006.01) |
| ***F21V 15/01*** | (2006.01) |
| ***F21V 31/00*** | (2006.01) |

(52) U.S. Cl.
CPC ..... *F21V 25/12* (2013.01); *F21S 8/036* (2013.01); *F21V 15/01* (2013.01); *F21V 15/02* (2013.01); *F21V 17/12* (2013.01); *F21V 31/005* (2013.01)

(58) Field of Classification Search
CPC ..... F21V 15/00; F21V 15/01; F21V 15/012; F21V 15/02; F21V 15/015; F21V 17/00; F21V 17/005; F21V 17/10; F21V 17/107; F21V 17/18; F21V 19/0055; F21V 21/26; F21V 21/28; F21V 29/00; F21V 29/10; F21V 29/507; F21V 29/70; F21V 25/12; F21V 17/12; F21V 31/005; F21S 8/037; F21S 8/04; F21S 8/043; F21S 8/00; F21S 8/036
See application file for complete search history.

(56) References Cited

U.S. PATENT DOCUMENTS

| | | | | |
|---|---|---|---|---|
| 4,345,306 | A * | 8/1982 | Summey | F21V 25/12 362/164 |
| 5,558,537 | A * | 9/1996 | Su | F21V 21/03 439/334 |
| 6,338,564 | B1 * | 1/2002 | Jordan | F21S 8/02 362/297 |
| 2010/0128483 | A1 * | 5/2010 | Reo | F21S 8/038 362/294 |
| 2010/0134046 | A1 * | 6/2010 | Holder | F21V 19/04 315/297 |
| 2012/0262917 | A1 * | 10/2012 | Courcelle | F21V 15/01 362/235 |
| 2013/0134880 | A1 * | 5/2013 | Rea | A01G 7/045 315/112 |
| 2014/0307445 | A1 * | 10/2014 | Highbridge | F21V 23/008 362/296.01 |

(Continued)

*Primary Examiner* — Isiaka O Akanbi
*Assistant Examiner* — Fatima N Farokhrooz

(57) ABSTRACT

An explosion proof lamp easy to be repaired and maintained comprises a lamp body, a metal guard covering the lamp body, a heat sinking lamp holder and a power supply box. The lamp body is installed on the lower end face of heat sinking lamp holder. The power supply box is mounted on the upper end face of heat sinking lamp holder. The power supply box comprises a box body and a cover body covering the box body. The box body is fixed to the upper end face of heat sinking lamp holder. The box body is connected to the cover body by screwed, and a slewing mechanism is provided on the side of joint of the box body and cover body. The slewing mechanism enables the box body and cover body to turn oppositely.

7 Claims, 4 Drawing Sheets

(56) References Cited

U.S. PATENT DOCUMENTS

| | | | | |
|---|---|---|---|---|
| 2015/0023020 | A1* | 1/2015 | Gattari | F21S 8/086<br>362/282 |
| 2016/0281967 | A1* | 9/2016 | Hunt, III | F21V 21/116 |
| 2017/0245350 | A1* | 8/2017 | Pisani | H02P 13/06 |
| 2017/0248296 | A1* | 8/2017 | Sekowski | F21V 21/30 |
| 2019/0059142 | A1* | 2/2019 | Chen | H05B 37/0227 |
| 2019/0113183 | A1* | 4/2019 | Levy | F21S 8/086 |

* cited by examiner

EXPLOSION PROOF LAMP

BACKGROUND OF INVENTION

1. Field of the Invention

The present invention relates generally to an explosion proof lamp which is easy to be repaired and maintained.

2. Description of Related Art

The lighting fixtures are used in production, storage and rescue more and more extensively, and the categories thereof are increasing. How to prevent the occurrence of accidental explosions of lighting fixtures in the dangerous places with explosive gases has become a very important topic. As the lighting fixtures inevitably generate electric sparks or form a fiery surface in operation, once it meets the explosive gas mixture in the field of production or rescue, an explosion accident happens. The explosion proof lamp is a sort of lamp applicable to this kind of dangerous place.

The conventional explosion proof lamp comprises a lamp body for emitting light, a metal guard covering the lamp body, a heat sinking lamp holder and a supply unit for driving the lamp body. For the sake of safety, the supply unit is usually enclosed in a box body. Finally, the explosion proof lamp is fixed by bracket to such stationary facilities as walls, or suspended.

The explosion proof lamp sometimes flickers abnormally in operation, this situation is resulted from some problems in the supply unit. The existing explosion proof lamp is difficult to be repaired or changed as the power supply box uses packaging structure, the whole explosion proof lamp must be taken down before repair, the maintenance cost and time are increased.

SUMMARY OF THE INVENTION

The purpose of the present invention is to overcome the deficiencies in the existing technology to provide an explosion proof lamp which is easy to be repaired and maintained.

In order to solve the above problems, the technical scheme of the present invention is described below:

An explosion proof lamp, comprising a lamp body, a metal guard covering the lamp body, a heat sinking lamp holder and a power supply box, wherein the lamp body is mounted on a lower end face of the heat sinking lamp holder, the power supply box is mounted on an upper end face of the heat sinking lamp holder;

wherein the power supply box includes a box body and a cover body covering the box body, the box body is fixed to the upper end face of the heat sinking lamp holder an upper end of the cover body is fixed to a brace, the box body is connected to the cover body by screws, and a slewing mechanism is provided on a side of joint of the box body and cover body, the slewing mechanism enables the box body and cover body to turn oppositely.

More particularly, wherein the slewing mechanism includes a pivot provided on the box body and a pivot slot provided on cover body; the pivot is engaged with the pivot slot to rotate the box body relative to the cover body.

More particularly, wherein the cover body includes a cylinder disposed on an upper end face thereof and a through hole disposed on the cylinder and connected to the power supply box; the brace includes a channel disposed therein for the power cord to pass through and a mounting hole disposed correspondingly to the cylinder, the mounting hole is connected to the channel;

wherein the power cord of the power supply box passes through the through hole to enter the channel in the brace via the mounting hole, and then is connected to an external power supply.

More particularly, wherein an outer edge of the cylinder includes lugs, and an inner edge of the mounting hole includes grooves corresponding to the lugs; when the cover body is connected to the brace, the lugs enter the mounting hole along the grooves, the cover body is rotated relative to the brace by a certain angle, so that the lugs and grooves are interlaced.

More particularly, wherein the cover body and the brace are connected with a threaded hole, and the cover body and the brace are fixed by screws More particularly, wherein an outer edge of the box body includes lower bulges uniformly disposed thereon, and the bulges have lower threaded holes; an outer edge of the cover body includes upper bulges corresponding to the lower bulges, and the upper bulges have upper threaded holes; the screws pass through the lower threaded holes and upper threaded holes from bottom to top to fix the box body and cover body.

More particularly, wherein one end of the brace is formed with a fixing plate, the fixing plate is fixed to a wall by screws.

More particularly, wherein one end of the brace is formed with a fixing plate, the fixing plate is fixed a bearing plate of a column by screws.

Effects of the Present Invention

The power supply box in the present invention is designed in separate form, the power supply box comprises a box body and a box cover. The box body is fixed to the heat sinking lamp holder of explosion proof lamp, the box cover is connected to the brace. To repair or change the circuit in the power supply box, as long as screws for fixing the box body and cover body are screwed out, the box body is opened spontaneously by the turning gear, thus the user can repair or change the circuit easily. Afterwards, the box body and cover body are put together and fastened by screws.

In the present invention, the power cord of power supply box passes through the through hole to enter the channel in the brace via the mounting hole, and then it is connected to the external power supply. Thus, the power cord is not exposed to the outside directly, and the safety of product is guaranteed.

In the present invention, the mounting structure between the cover body of power supply box and the brace is simple, convenient for assembly and disassembly.

DETAILED DESCRIPTION OF THE INVENTION

Figure 1:
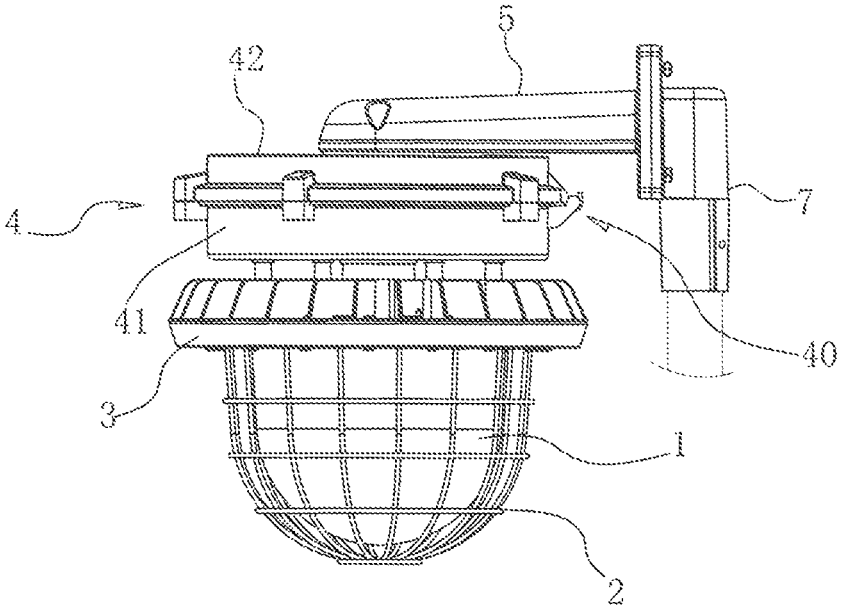
FIG. 1 is a front view of an embodiment 1 of the present invention.
Figure 2:
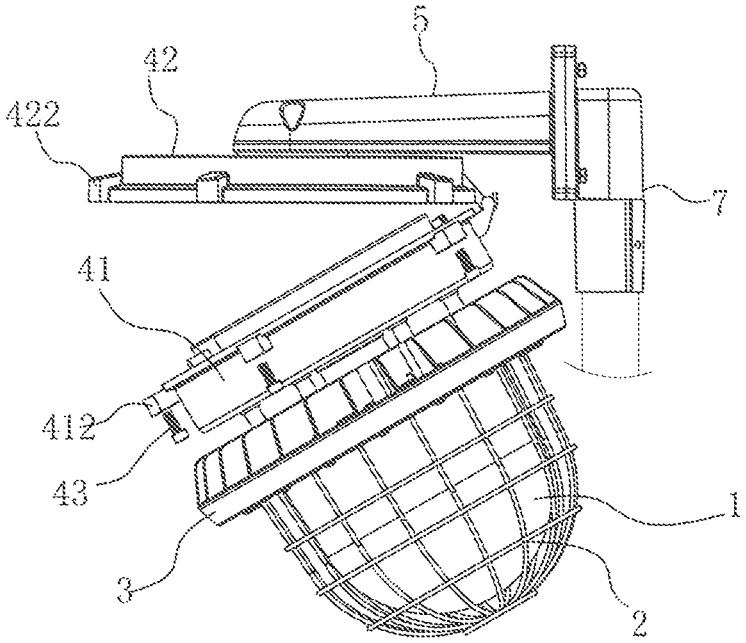
FIG. 2 is a front view of a power supply box in opening state in the embodiment 1 of the present invention.

FIG. 1 to FIG. 5 show the embodiment 1 of an explosion proof lamp of the present invention, which comprises a lamp body 1, a metal guard 2 covering the lamp body 1, a heat sinking lamp holder 3, a power supply box 4 and a brace 5. The lamp body 1 is installed on the lower end face of heat sinking lamp holder 3, the power supply box 4 is installed on the upper end face of heat sinking lamp holder 3, the brace 5 is installed above the power supply box 4.

The power supply box 4 comprises a box body 41 and a cover body 42 covering the box body 1. The box body 41 is fixed to the upper end face of heat sinking lamp holder 3. The upper end of the cover body 42 is fixed to a brace 5. The box body 41 is connected to the cover body 42 by screws 43, and a slewing mechanism 40 is provided on the side of joint of the box body 41 and cover body 42, the slewing mechanism 40 enables the box body 41 and cover body 42 to turn against each other. To be specific, the slewing mechanism 40 comprises a pivot 411 provided on box body 41 and a pivot slot 421 provided on the cover body 42. The pivot 411 and pivot slot 421 work with each other to implement relative turn of box body 41 and cover body 42. For the convenience of assembly, the pivot slot 421 is a semi-open slot, the opening thereof is upward. For assembly, the pivot 411 of box body 41 is hanged by the pivot slot 421 of cover body 42, the relative turn between box body 41 and cover body 42 can be implemented, and the box body 41 and cover body 42 can be separated quickly.

The box body 41 and cover body 42 are connected flexibly by the slewing mechanism 40. However, the power supply box 4 must keep closed in operation, so the two components shall be connected by screws 43. The specific structure is described below, there are lower bulges 412 arranged uniformly on the outer edge of the box body 41, there are lower threaded holes in the bulges 412. There are upper bulges 422 corresponding to the lower bulges 412 on the outer edge of the cover body 42, there are upper threaded holes in the upper bulges 422. The screws 43 pass through the lower threaded holes and upper threaded holes from bottom to top to fix the box body 41 and cover body 42.

In addition, in order to guarantee the closeness between box body 41 and cover body 42, a sealing strip 413 is fixed to the end face of joint of the box body 41 and cover body 42 by clamping or bonding. A seal groove 423 corresponding to the sealing strip 413 is formed on the corresponding end face of the cover body 42. When the box body 41 and cover body 42 are fixed by screws 43, with combination of sealing strip 413 and seal groove 423 can keep the joint end face of box body 41 and cover body 42 closed to avoid rain water entering the power supply box 4.

A cylinder 44 is provided on the upper end face of the cover body 42, a through hole 441 connected to the power supply box 4 is located in the cylinder 44. There is a channel 50 for the power cord to go through in the brace 5, and a mounting hole 51 corresponding to cylinder 44 is located in the brace 5. The mounting hole 51 is connected to channel 50. The power cord of power supply box 4 passes through the through hole 441 to enter the channel 50 in brace 5 via the mounting hole 51, and then it is connected to the external power supply.

The brace 5 and cover body 42 are connected in the following way, there are lugs 45 on the outer edge of the cylinder 44, there are grooves 52 corresponding to the lugs 45 on the inner edge of the mounting hole 51; to connect the cover body 42 and brace 5, the lugs 45 enter the mounting hole 51 along the grooves 52, the cover body 42 and brace 5 are turned oppositely for an angle, the lugs 45 and grooves 52 are interlaced. The interlaced lugs 45 and grooves 52 can suspend the cover body 42 on the brace 5. Certainly, in order to guarantee stable connection between cover body 42 and brace 5, a threaded hole can be made in the joint of the cover body 42 and brace 5, the two parts can be fastened by screw.

Figure 3:
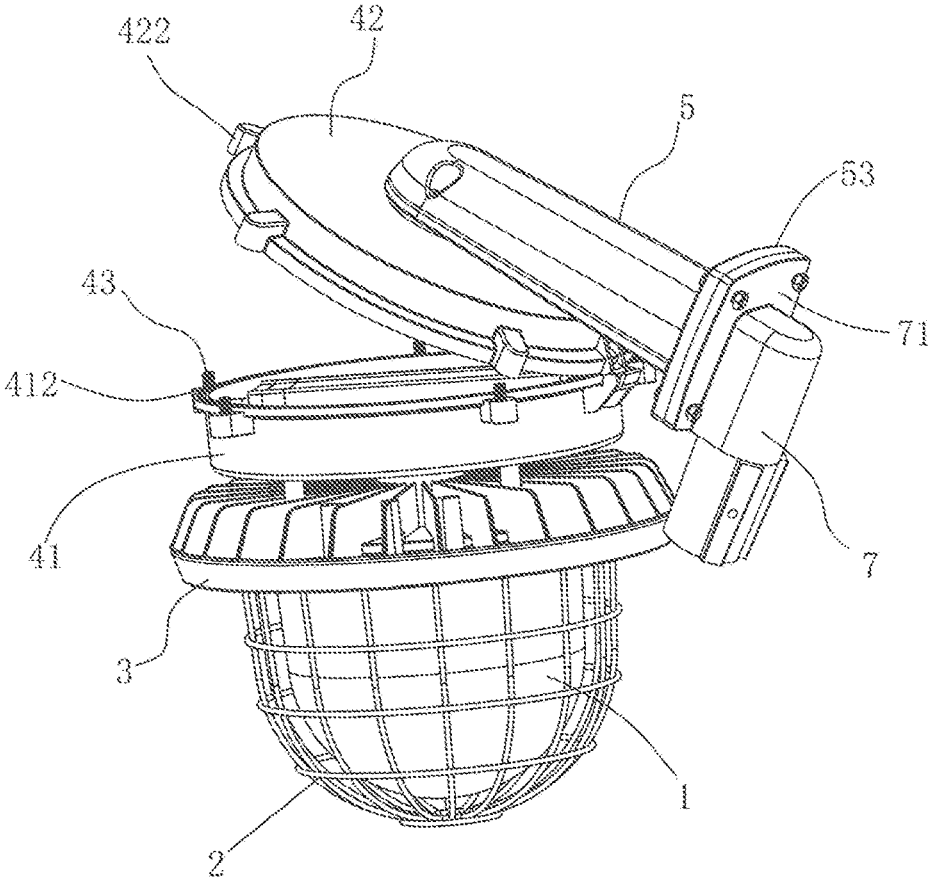
FIG. 3 is a schematic view of the embodiment 1 of the present invention.
Figure 4:
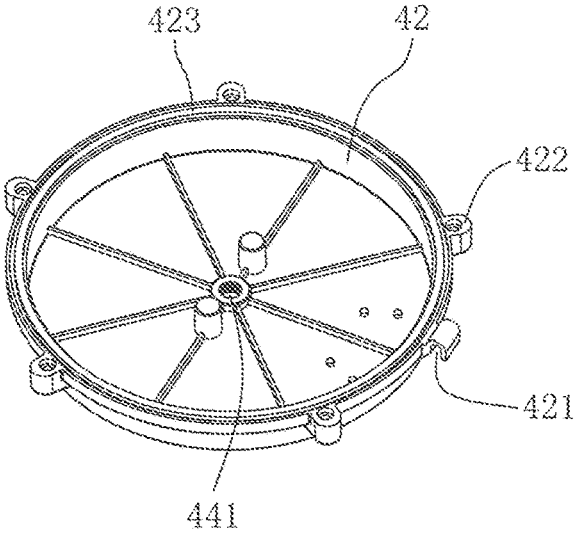
FIG. 4 is a schematic view of a cover body in the embodiment 1 of the present invention.
Figure 5:
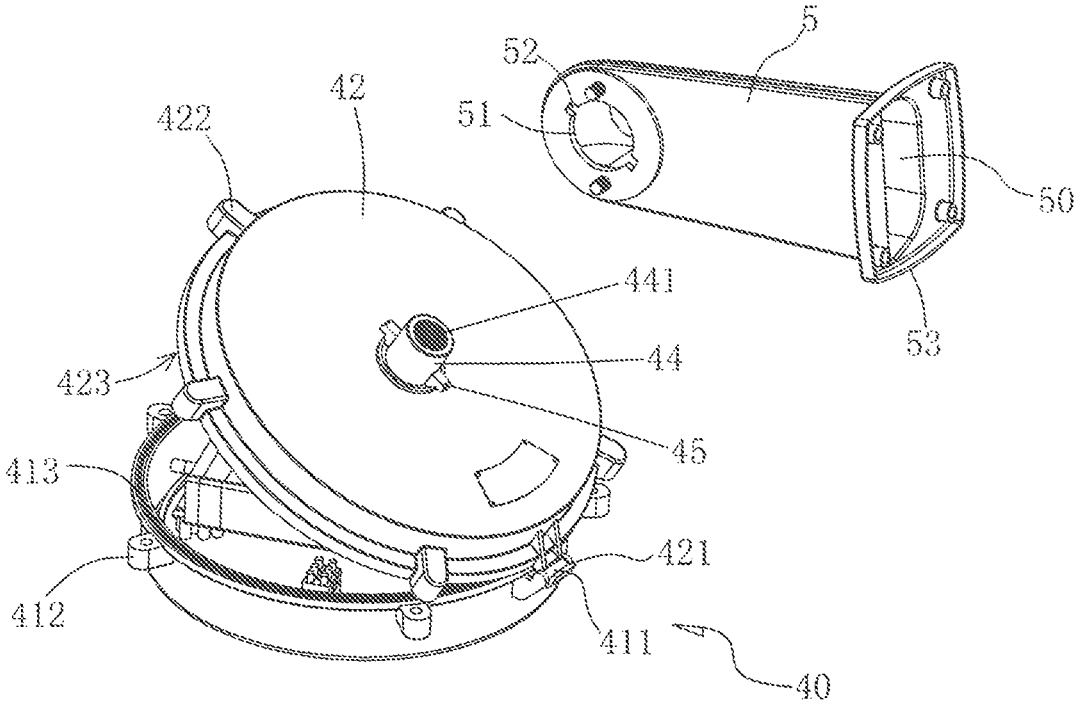
FIG. 5 is a three-dimensional exploded diagram of the power supply box and a brace in the embodiment 1 of the present invention.

In addition, for installing the present invention, the present invention can be fixed by brace 5 to some stationary facilities. As shown in FIG. 3, a fixing plate 53 is formed at one end of brace 5, the fixing plate 53 is fixed to the bearing plate 71 of a column 7 by screws, so that the bearing plate 71 and brace 5 are distributed vertically.

Figure 6:
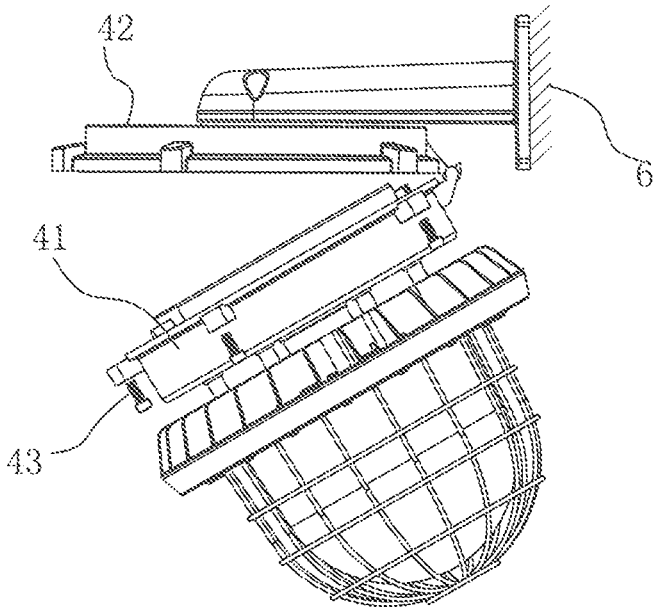
FIG. 6 is a front view of the power supply box in opening state in an embodiment 2 of the present invention.

FIG. 6 is an embodiment 2 of the present invention. A fixing plate 53 is formed at one end of the brace 5 in this case, the fixing plate 53 is fixed to the wall 6 by screws.

Figure 7:
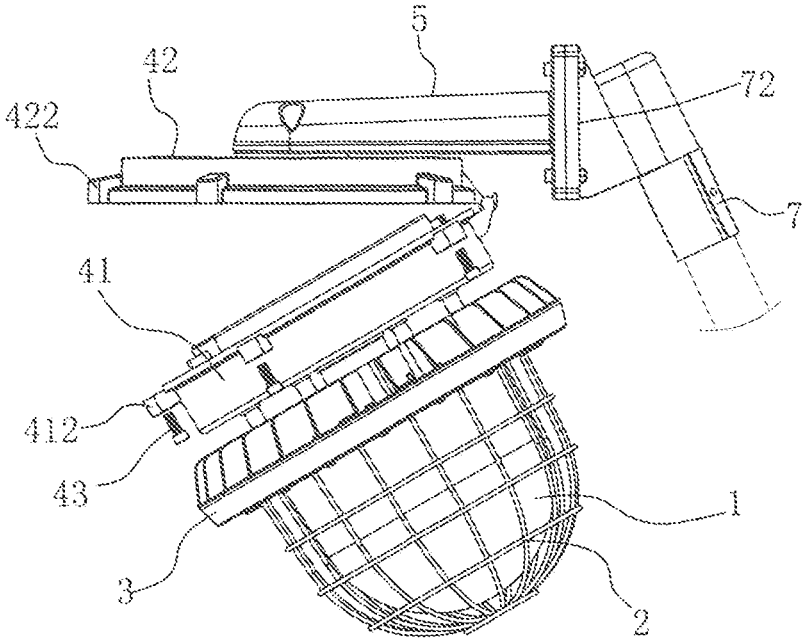
FIG. 7 is a front view of the power supply box in opening state in the embodiment 3 of the present invention.

FIG. 7 is the embodiment 3 of the present invention. A fixing plate 53 is formed at one end of the brace 5 in this case, the column 7 is provided with an inclined plate 72, the fixing plate 53 is fixed to the inclined plate 72 by screws, thus, the column 7 and brace 5 are distributed nonvertically.

Figure 8:
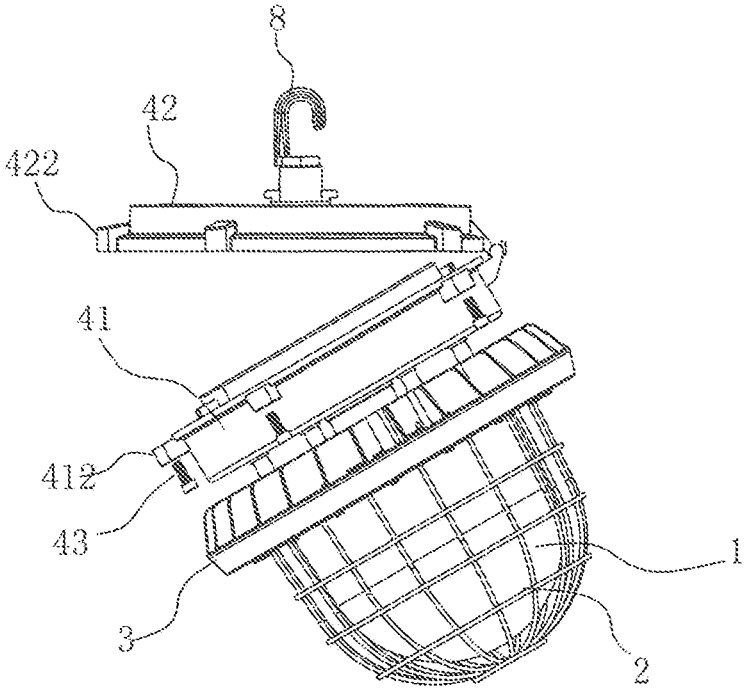
FIG. 8 is a front view of the power supply box in opening state in the embodiment 4 of the present invention.

FIG. 8 is the embodiment 4 of the present invention. Differing from the aforesaid cases, this case is free of brace 5, but using a hook 8 directly. The hook 8 can be connected in the through hole 441 of cylinder 44 by screw thread, so that the embodiment 4 can be suspended for installation.

I claim:

1. An explosion proof lamp, comprising a lamp body (1), a metal guard (2) covering the lamp body (1), a heat sinking lamp holder (3) and a power supply box (4), wherein the lamp body (1) is mounted on a lower end face of the heat sinking lamp holder (3), the power supply box (4) is connected to an upper end face of the heat sinking lamp holder (3) at a distance by a plurality of connecting components;

wherein the power supply box (4) includes a box body (41) and a cover body (42) covering the box body (1), the box body (41) is fixed to the upper end face of the heat sinking lamp holder (3); an upper end of the cover body (42) is fixed to a brace (5), the box body (41) is connected to the cover body (42) by screws (43), and a slewing mechanism (40) is provided on a side of joint of the box body (41) and cover body (42), the slewing mechanism (40) enables the box body (41) and cover body (42) to turn oppositely;

wherein the slewing mechanism (40) includes a pivot pin (411) provided on the box body (41) and a Divot slot (421) provided on cover body (42); the pivot pin (411) is engaged with the pivot slot (421) to rotate the box body (41) relative to the cover body (42).

2. The explosion proof lamp defined in claim 1, wherein the cover body (42) includes a cylinder (44) disposed on an upper end face thereof and a through hole (441) disposed on the cylinder (44) and connected to the power supply box (4); the brace (5) includes a channel (50) disposed therein for the power cord to pass through and a mounting hole (51) disposed correspondingly to the cylinder (44), the mounting hole (51) is connected to the channel (50);

wherein the power cord of the power supply box (4) passes through the through hole (441) to enter the channel (50) in the brace (5) via the mounting hole (51), and then is connected to an external power supply.

3. The explosion proof lamp defined in claim 1, wherein an outer edge of the box body (41) includes lower bulges (412) uniformly disposed thereon, and the bulges (412) have lower threaded holes; an outer edge of the cover body (42) includes upper bulges (422) corresponding to the lower bulges (412), and the upper bulges (422) have upper threaded holes; the screws (43) pass through the lower threaded holes and upper threaded holes from bottom to top to fix the box body (41) and cover body (42).

4. The explosion proof lamp defined in claim 1, wherein one end of the brace (5) is formed with a fixing plate (53), the fixing plate (53) is fixed to a wall (6) by screws.

5. The explosion proof lamp defined in claim 1, wherein one end of the brace (5) is formed with a fixing plate (53), the fixing plate (53) is fixed to a bearing plate (71) of a column (7) by screws.

6. The explosion proof lamp defined in claim 2, wherein an outer edge of the cylinder (44) includes lugs (45), and an inner edge of the mounting hole (51) includes grooves (52) corresponding to the lugs (45); when the cover body (42) is connected to the brace (5), the lugs (45) enter the mounting hole (51) along the grooves (52), the cover body (42) is rotated relative to the brace (5) by a certain angle, so that the lugs (45) and grooves (52) are interlaced.

7. The explosion proof lamp defined in claim 2, wherein the cover body (42) and the brace (5) are connected with a threaded hole, and the cover body (42) and the brace (5) are fixed by screws.

* * * * *